US006113708A

United States Patent [19]

Hopple et al.

[11] Patent Number: 6,113,708

[45] Date of Patent: Sep. 5, 2000

[54] CLEANING OF FLAT-PANEL DISPLAY

[75] Inventors: George B. Hopple, Palo Alto; Scott J. Crane, Prunedale; Bob L. Mackey, San Jose; John D. Porter, Berkeley, all of Calif.

[73] Assignees: Candescent Technologies Corporation, San Jose; Hewlett-Packard Company, Palo Alto, both of Calif.

[21] Appl. No.: 09/085,037

[22] Filed: May 26, 1998

[51] Int. Cl.[7] ..... B08B 3/00

[52] U.S. Cl. ..... 134/7; 134/1.3; 134/2; 134/6; 134/25.4; 134/31; 510/175; 510/405; 510/407; 510/412

[58] Field of Search ..... 134/1.3, 2, 6, 7, 134/25.4, 31; 510/135, 405, 407, 412

[56] References Cited

U.S. PATENT DOCUMENTS

| | | | |
|---|---|---|---|
| 5,013,366 | 5/1991 | Jackson et al. | 134/1 |
| 5,024,968 | 6/1991 | Engelsberg | 437/173 |
| 5,068,040 | 11/1991 | Jackson | 210/748 |
| 5,099,557 | 3/1992 | Engelsberg | 29/25.01 |
| 5,213,619 | 5/1993 | Jackson et al. | 134/1 |
| 5,306,350 | 4/1994 | Hoy et al. | 134/22.4 |
| 5,316,591 | 5/1994 | Chao et al. | 134/34 |
| 5,339,844 | 8/1994 | Stanford, Jr. et al. | 134/107 |
| 5,344,493 | 9/1994 | Jackson | 134/1 |
| 5,370,742 | 12/1994 | Mitchell et al. | 134/10 |
| 5,456,759 | 10/1995 | Stanford, Jr. et al. | 134/1 |
| 5,522,938 | 6/1996 | O'Brien | 134/1 |
| 5,559,389 | 9/1996 | Spindt et al. | 313/310 |
| 5,564,959 | 10/1996 | Spindt et al. | 445/24 |
| 5,643,472 | 7/1997 | Engelsberg et al. | 216/65 |
| 5,649,847 | 7/1997 | Haven | 445/24 |
| 5,675,212 | 10/1997 | Schmid et al. | 313/422 |

FOREIGN PATENT DOCUMENTS

| | | |
|---|---|---|
| WO 90-06189 | 6/1990 | WIPO . |
| WO 97/46739 | 12/1997 | WIPO . |

OTHER PUBLICATIONS

"A cleaning alternative to CFC's and volatile organic compounds," EnviroPro Technologies, 1992, 1 p.

*CRC Handbook of Chemistry and Physics* (65th ed., CRC Press), 1984, pp. F–62—F–64, F–74, and F105.

"Liquid assets, New fluid–extraction process moves toward commercialization," *Food Processing*, Oct. 1996, p. 77.

"Replacing CFC's and volatile organic compounds, EP 2000 Industrial precision Cleaning Systems," EnviroPro Technologies, 1993, 6 pp.

"Two–Step Process, Non–aqueous Cleaning System From Autoclave Engineers," EnviroPro Technologies, Mar. 1994, 10 pp.

Chao et al, "Precision Cleaning in the Computer Industry Using Ultrasonics in Carbon dioxide," undated but prior to 1994, 1 p.

Gallagher et al, "Supercritical Fluid Processing of Polymers," *Polymer Preprints*, vol. 31, No. 1, Apr. 1990, pp. 668–670.

Marshall et al, "Natural Convection Supercritical Fluid Cleaning Applications," 28th Int'l SAMPE Tech. Conf., Nov. 4–7, 1996, pp. 20–27.

McHardy et al, "Progress in Supercritical $CO_2$ Cleaning," *Sampe J.*, vol. 29, No. 5, Sep./Oct. 1993, pp 1–13.

Stanford, "Supercritical Fluids for Environmenntally Conscious Manufacturing," 2nd Annual Workshop on Solvent Substitution, Dec. 12, 1991, 5 pp.

*Primary Examiner*—Randy Gulakowski
*Assistant Examiner*—S. Carrillo
*Attorney, Agent, or Firm*—Skjerven, Morrill, MacPherson, Franklin & Friel LLP; Ronald J. Meetin

[57] ABSTRACT

A component (10 or 12) of a flat-panel display is cleaned with a fluid having a mole-fraction dominant constituent. The cleaning operation is performed by subjecting the component to the cleaning fluid while its absolute pressure exceeds the absolute pressure at the triple point of the dominant constituent and is at least 20% of the absolute pressure value at the critical point of the dominant constituent. The temperature and pressure of the cleaning fluid are typically controlled in a direction toward the supercritical state of the dominant constituent.

28 Claims, 4 Drawing Sheets

CLEANING OF FLAT-PANEL DISPLAY

FIELD OF USE

This invention relates to cleaning devices such as flat-panel displays. More particularly, this invention relates to cleaning components of flat-panel displays of the cathode-ray tube ("CRT") type.

BACKGROUND

A flat-panel CRT display consists of an electron-emitting device and a light-emitting device that operate at low internal pressure. The electron-emitting device, commonly referred to as a cathode, contains electron-emissive elements that emit electrons over a relatively wide area. The emitted electrons are directed towards light-emissive elements distributed over a corresponding area in the light-emitting device. Upon being struck by the electrons, the light-emissive elements emit light that produces an image on the viewing surface of the display.

The inside of a flat-panel display needs to be clean during display operation. Contaminants on the surfaces of the electron-emissive elements increase electron tunneling barriers. As a result, higher operating voltages are needed in the display. Also, contamination of the electron-emissive surfaces produces emission non-uniformity and instability. This leads to non-uniform brightness on the display's viewing surface. Display efficiency is reduced.

Organic materials, such as polyimide residues, are one potential source of contamination in flat-panel CRT displays. Haven, U.S. Pat. No. 5,649,847, discloses two primary display components that contain polyimide: (a) a system that focuses electrons emitted by the electron-emissive elements and (b) a "black" matrix situated around the light-emissive elements for improving image contrast. It is desirable to have an economical, environmentally safe technique for removing contaminants from a flat-panel CRT display, especially organic contaminants that arise from using materials such as polyimide in the display.

GENERAL DISCLOSURE OF THE INVENTION

The invention furnishes a technique for cleaning a device, such as a component of a flat-panel display, with fluid having a mole-fraction dominant constituent. The term "fluid" is utilized here in the general sense to mean non-solid matter that can be in the liquid state, in the gaseous state, or in a condition where the liquid and gaseous states are essentially indistinguishable. The mole-fraction dominant constituent of the cleaning fluid employed in the invention is present at a greater mole fraction in the fluid than any other individual constituent of the fluid. The dominant constituent is typically a mole-fraction majority of the cleaning fluid. That is, to the extent that the fluid includes matter other than the dominant constituent, the mole fraction of the dominant constituent is greater than the mole fraction of the remainder of the fluid.

More particularly, in accordance with the invention, a component of a flat-panel display is cleaned by subjecting the component to the present cleaning fluid while its absolute pressure is at least 20% of the absolute pressure value at the critical point of the mole-fraction dominant constituent. Starting at the triple point where the solid, liquid, and gaseous phases of a type of matter, such as an element or compound, are in equilibrium and going up the liquidus line which separates the liquid and gaseous phases of the matter and along which the matter is a fluid, the end of the liquidus line is the critical point at which the liquid and gaseous phases of the fluid are essentially indistinguishable. The critical point is at greater pressure and temperature values than the triple point. Inasmuch as a pressure equal to 20% of the absolute pressure value at the critical point of the dominant constituent is normally much greater than 1 atm, the present cleaning fluid is normally in a high-pressure condition during the cleaning operation.

A fluid is in the "supercritical state" when the temperature and pressure of the fluid respectively exceed the temperature and pressure values at the fluid's critical point. The temperature and pressure of the cleaning fluid used in the invention are normally controlled in a direction towards the supercritical state of the dominant constituent. During the present cleaning operation, the pressure of the cleaning fluid usually reaches at least 50%, preferably at least 90%, of the critical pressure of the dominant constituent. As such, the cleaning fluid is suitable for cleaning a display component that is relatively sturdy, especially when the fluid's absolute temperature reaches at least 96% of the absolute critical temperature of the dominant constituent.

The display component may be relatively delicate. In that case, the temperature and pressure of the cleaning fluid are normally moved further towards the supercritical state of the dominant constituent. During the cleaning operation, the fluid's temperature preferably goes above the dominant constituent's critical temperature. Likewise, the fluid's pressure preferably goes above the dominant constituent's critical pressure.

The flat-panel display is typically of the CRT type. One display component cleanable according to the invention is an electron-emitting device of the flat-panel CRT display. Another display component cleanable according to the invention is a light-emitting device of the display.

Both the electron-emitting and light-emitting devices typically contain subcomponents formed with organic material such as polyimide. Residues of the organic material can migrate to undesirable locations in the electron-emitting and light-emitting devices. Such migration often occurs during fabrication steps that precede usage of the present cleaning technique and, if not prevented, can occur during display operation. The migrated organic residue can cause serious performance degradation. The present cleaning technique is utilized to remove a substantial portion of the potentially damaging organic residue, thereby largely avoiding performance degradation that would otherwise be caused by the organic residue.

The solvency (ability to dissolve material) of the present cleaning fluid at the elevated pressure employed in the present cleaning technique is normally quite high compared to the fluid's solvency at standard pressure. Similarly, the viscosity and surface tension of the cleaning fluid at the elevated pressure utilized in the invention are normally quite low compared to the fluid's viscosity and surface tension at standard pressure. These characteristics lead to rapid wetting of, and good penetration into, material that comes in contact with the fluid. Consequently, the elevated-pressure fluid used in the invention provides excellent leaning performance.

The dominant component of the present cleaning fluid is typically carbon dioxide which does not cause significant damage to the environment. The invention thereby provides an efficient, environmentally safe, way for cleaning components of a flat-panel display.

BRIEF DESCRIPTION OF THE DRAWINGS

Like reference symbols are employed in the drawings and in the description of the preferred embodiments to represent the same, or very similar, item or items.

DESCRIPTION OF THE PREFERRED EMBODIMENTS

The present invention furnishes a technique for cleaning components of a flat-panel CRT display prior to assembly of the display. The assembled display is typically a flat-panel television or a flat-panel video monitor suitable for a personal computer, a lap-top computer, or a work station. The so-cleaned components of the flat-panel display typically include an electron-emitting device, a light-emitting device, and any component, such as a gettering system, attached to the electron-emitting or light-emitting device prior to the cleaning operation. The cleaned components may also include an outer wall situated between the electron-emitting and light-emitting devices to form a low-pressure enclosure, and a spacer system situated in the enclosure for resisting external forces, such as air pressure, exerted on the display. Some of the cleaned display components normally contain organic material, e.g., polyimide.

Figure 1:
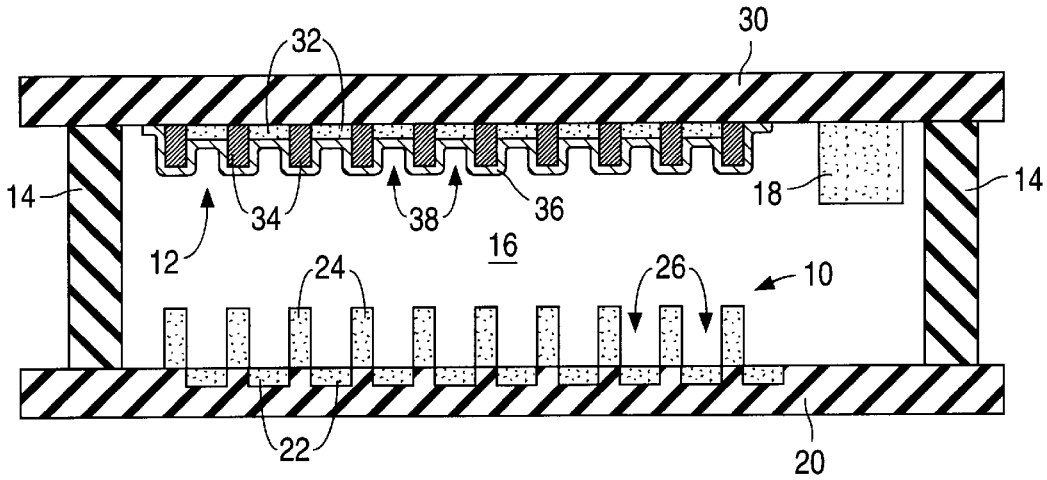
FIG. 1 is a cross-sectional side structural view of a flat-panel CRT display having components suitable for being cleaned in accordance with the invention.

FIG. 1 generally illustrates an assembled color flat-panel CRT display having polyimide-containing components that are cleaned according to the invention prior to display assembly. The polyimide-containing components include an electron-emitting device 10 and a light-emitting device 12 connected together through a rectangular annular outer wall 14 to form a sealed enclosure 16 maintained at a high vacuum, typically $10^{-7}$ torr or less. A getter 18 is situated in enclosure 16, typically on light-emitting device 12, for collecting gases present in enclosure 16. A spacer system (not shown) is situated within enclosure 16 for resisting external forces exerted on the display and for maintaining a relatively constant spacing between devices 10 and 12.

Electron-emitting device 10 is a field-emission cathode (or field emitter) consisting of an electrically insulating baseplate 20, an electron-emitting mechanism 22, and an electron-focusing system 24. Electron-emitting mechanism 22, illustrated schematically in FIG. 1, is situated along the interior surface of baseplate 20. Electron-focusing system 24, situated above the interior surface of baseplate 20, focuses electrons that mechanism 22 emits according to field emission. The emitted electrons pass through openings 26 in focusing system 24 and move towards light-emitting device 12.

Light-emitting device 12 is formed with a transparent electrically insulating faceplate 30, an array of light-emissive phosphor elements 32, a "black" matrix 34, and a thin light-reflective anode layer 36. Light-emissive phosphor elements 32 are situated along the interior surface of faceplate 30 respectively across from focus openings 26. Black matrix 34, arranged generally in a waffle-like pattern as viewed perpendicular to the interior surface of faceplate 30, laterally surrounds light-emissive elements 32. Anode layer 36 is situated on black matrix 34 and extends into openings 38 down to light-emissive elements 32.

During display operation, portions of electron-emitting mechanism 22 selectively emit electrons that pass through corresponding ones of focus openings 26. As anode layer 36 attracts the emitted electrons towards light-emitting device 12, focusing system 24 focuses the electrons so that they pass through layer 36 and strike light-emissive elements 32 in corresponding ones of openings 38. Upon being struck by electrons, elements 32 emit light that produces an image on the exterior surface of faceplate 30.

The flat-panel display of FIG. 1 can be modified in various ways. For instance, focusing system 24 can be deleted if the spacing between devices 10 and 12 is sufficiently small. Contrary to what is illustrated in FIG. 1, black matrix 34 need not be raised relative to light-emissive elements 32. Anode layer 36 can be continuous or segmented. Also, layer 36 can be replaced with a transparent anode consisting, for example, of indium tin oxide situated between faceplate 30 and elements 32.

Organic material, typically polyimide, is present at various places in the flat-panel display of FIG. 1. For example, focusing system 24 typically contains exposed photopolymerizable polyimide. Black matrix 34 typically consists of exposed photopolymerizable polyimide. Also, getter 18 has attachment clips that are bonded to light-emitting device 12 (or field emitter 10) with adhesive typically formed with organic material such as polyimide.

Prior to assembling field emitter 10 and light-emitting device 12 through outer wall 14, devices 10 and 12 are each cleaned with high-pressure fluid in accordance with the invention to remove certain contaminants, especially non-volatile residues of organic materials employed in forming some of the display components. The organic residue contaminant normally includes monomer, dimer, trimer, and other oligomer formation constituents, i.e., unreacted or/and partially reacted constituents, of the exposed photopolymerizable polyimide present in focusing system 24 and black matrix 34. This organic residue is not permanently chemically bonded to the display components. Consequently, the organic residue can or/and does migrate to locations in the flat-panel display where the residue, if not removed, can contaminate devices 10 and 12 and the (unshown) spacer system. Such contamination can cause degraded display performance.

Specifically, light-emitting device 12 normally undergoes processing at high temperature, typically in the vicinity of 400° C., subsequent to the formation of black matrix 34. During this high-temperature processing, residues of the exposed polyimide material can or/and do migrate into openings 38. If not removed, the polyimide residues in openings 38 darken upon being bombarded by electrons emitted from mechanism 22 during display operation. The display brightness and efficiency are reduced.

In addition, migrated polyimide residue can cause non-uniformity in the brightness of the flat-panel display. During the process of assembling devices emitter 10 and 12 (through outer wall 14), the display is subjected to high temperature, typically in the vicinity of 350° C. If the polyimide residue is not removed, it can migrate during the high-temperature display assembly process and accumulate at undesirable locations on field emitter 10. Such migration can also occur during display operation. In any event, the result is non-uniform electron emission and consequent non-uniform display brightness. These difficulties are overcome by cleaning devices 10 and 12 with high-pressure fluid in accordance with the invention.

The present cleaning fluid consists of a mole-fraction dominant constituent and possibly one or more additional constituents (additives) for enhancing the cleaning performance in various ways. The dominant constituent, which is present at a greater mole fraction in the cleaning fluid than any other individual constituent of the fluid, is normally a mole-fraction majority of the fluid. In a typical formulation of the cleaning fluid, the dominant constituent is in the vicinity of 95% or more of the fluid by mole fraction. Subject to the triple-point and critical-point considerations discussed below, the dominant constituent is normally a gas at room temperature, approximately 25° C., and standard absolute pressure, 1 atm. In other words, the dominant constituent normally has a boiling point below 25° C. at 1 atm absolute.

Various fluids can be employed as the dominant constituent of the cleaning fluid in the present cleaning technique. Table I presents compounds, all having boiling points below 25° C. at 1 atm absolute, that are candidates for the dominant constituent:

TABLE I

| Name | Formula |
|---|---|
| Carbon dioxide | $CO_2$ |
| Ammonia | $NH_3$ |
| Nitrous oxide | $N_2O$ |
| Sulfur dioxide | $SO_2$ |
| Sulfur hexafluoride | $SF_6$ |
| Methane | $CH_4$ |
| Ethane | $C_2H_6$ |
| Propane | $C_3H_8$ |
| Butane (both isomers) | $C_4H_{10}$ |
| Pentane (neopentane isomer only) | $C_5H_{12}$ |
| Ethene | $C_2H_4$ |
| Propene | $C_3H_6$ |
| Butene (at least 1-butene and 2-butene isomers) | $C_4H_8$ |
| Pentene (3-methyl 1-butene isomer only) | $C_5H_{10}$ |
| Fluoromethane | $CH_3F$ |
| Difluoromethane | $CH_2F_2$ |
| Trifluoromethane | $CHF_3$ |
| Tetrafluoromethane | $CF_4$ |
| Fluoroethane | $C_2H_5F$ |
| Difluoroethane (1,1-difluoro isomer only) | $C_2H_4F_2$ |
| Trifluoroethane (at least 1,1,1-fluoro isomer) | $C_2H_3F_3$ |
| Tetrafluoroethane (at least 1,1,1,2-fluoro isomer) | $C_2H_2F_4$ |
| Hexafluoroethane | $C_2F_6$ |
| Fluoropropane (at least 1-fluoro isomer) | $C_3H_7F$ |
| Difluoropropane (2,2-fluoro isomer only) | $C_3H_6F_2$ |
| Hexafluoropropane (at least 1,1,1,2,2,3-fluoro isomer) | $C_3H_2F_6$ |
| Octafluoropropane | $C_3F_8$ |
| Decafluorobutane | $C_4F_{10}$ |
| Difluoroethene (at least 1,1-fluoro isomer) | $C_2H_2F_2$ |
| Fluoropropene (at least 3-fluoro isomer) | $C_3H_5F$ |
| Chloromethane | $CH_3Cl$ |
| Chloroethane | $C_2H_5Cl$ |
| Chlorofluoromethane | $CH_2ClF$ |
| Dichlorofluoromethane | $CHCl_2F$ |
| Chlorodifluoromethane | $CHClF_2$ |
| Chlorotrifluoromethane | $CClF_3$ |
| Dichlorodifluoromethane | $CCl_2F_2$ |
| Trichlorofluoromethane | $CCl_3F$ |
| Chlorotrifluoroethane (at least 2-chloro-1,1,1-fluoro isomer) | $C_2H_2ClF_3$ |
| Chloropentafluoroethane | $C_2ClF_5$ |
| Dichlorotetrafluoroethane (at least 1,1-chloro-1,2,2,2-fluoro isomer) | $C_2Cl_2F_4$ |
| Bromomethane | $CH_3Br$ |
| Bromofluoromethane | $CH_2BrF$ |
| Bromotrifluoromethane | $CBrF_3$ |
| Dibromodifluoromethane | $CBr_2F_2$ |
| Iodotrifluoromethane | $CIF_3$ |

The dominant constituent can also be formed with any of the additional candidates, all having boiling points between 25° C. and 75° C., presented in Table II below:

TABLE II

| Name | Formula |
|---|---|
| Carbon disulfide | $CS_2$ |
| Hexan (at least normal hexane, neohexane, and 2,3-dimethyl butane isomers | $C_6H_{14}$ |
| Dichloromethane | $CH_2Cl_2$ |
| Trichloromethane | $CHCl_3$ |
| Dichloroethane (at least 1,1 isomer) | $C_2H_4Cl_2$ |
| Chloropropane (both isomers) | $C_3H_7Cl$ |
| Chloropropene (at least 3-chloro isomer) | $C_3H_5Cl$ |
| Chlorodifluoropropane (at least 1-chloro-2,2-difluoro isomer | $C_3H_5ClF_2$ |
| Chlorofluoroethane (at least 1-chloro-2-fluoro isomer) | $C_2H_4ClF$ |
| Dichlorofluoroethane (at least 1,1-chloro-1-fluoro isomer) | $C_2H_3Cl_2F$ |
| Dichlorodifluoroethane (at least 1,2-chloro-1,1-fluoro isomer) | $C_2H_2Cl_2F_2$ |
| Trichlorotrifluoroethane (both isomers) | $C_2Cl_3F_3$ |
| Methanol | $CH_3OH$ |
| Diethyl ether | $C_4H_{10}O$ |

Nitrogen is typically not employed as the mole-fraction dominant constituent of the present cleaning fluid. The same applies to oxygen. For both nitrogen and oxygen, the absolute temperature at the triple point is below 100K (−173° C.). In this regard, all of the compounds in Tables I and II have triple-point temperatures above 100K except methane, ethane, and propane.

Carbon dioxide is particularly attractive for use as the dominant constituent of the present cleaning fluid, primarily because carbon dioxide is of low hazard. Exposure to carbon dioxide in moderate levels does not cause damage to humans and other life forms. Nor does exposure to carbon dioxide cause other significant environmental damage. As noted below, contaminants that dissolve in carbon dioxide are later removed from the carbon dioxide. Consequently, the "de-contaminated" carbon dioxide can be discharged to the atmosphere without causing environmental damage. Alternatively, the de-contaminated carbon dioxide can be recycled to provide cost savings.

Figure 2:
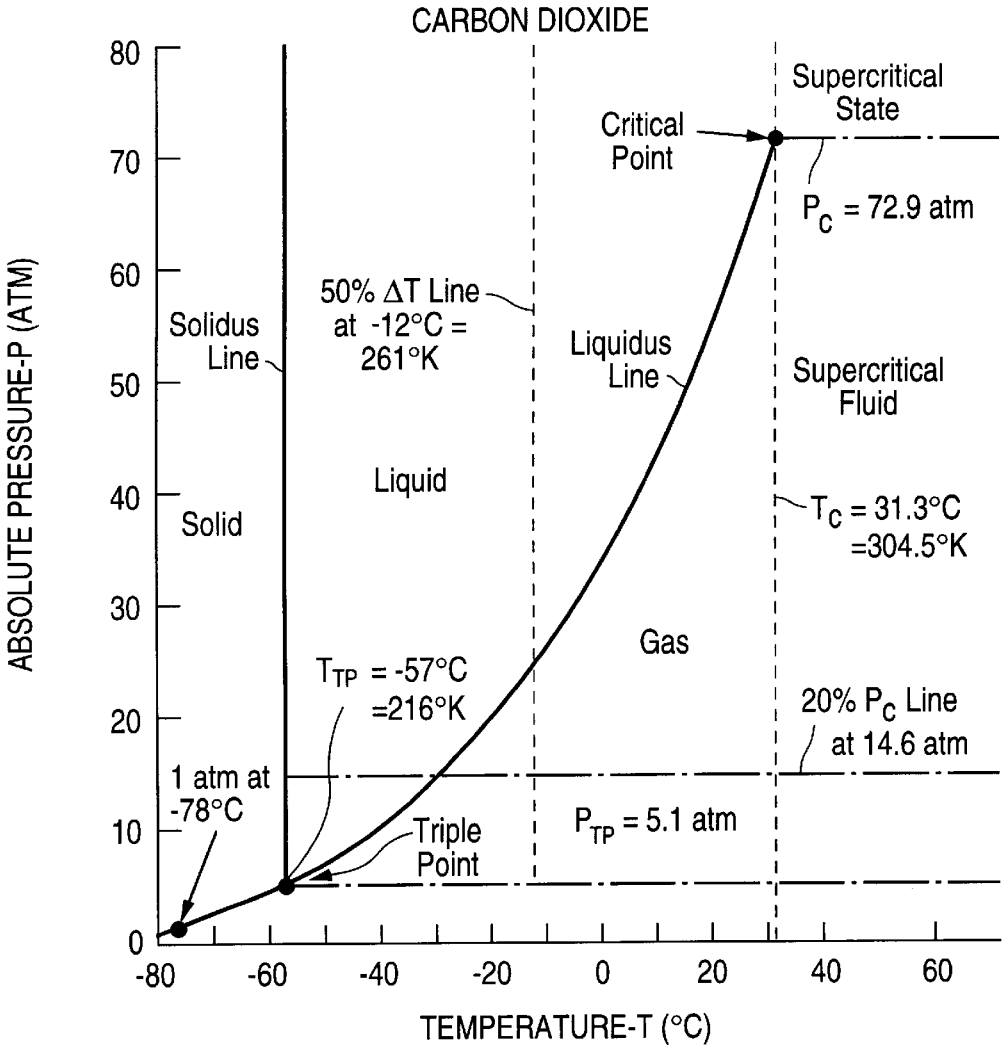
FIG. 2 is a phase diagram of pure carbon dioxide, a fluid suitable for use in cleaning polyimide-containing components of a flat-panel CRT display according to the invention.

FIG. 2 depicts the phase diagram of pure carbon dioxide. This phase diagram is useful in understanding the pressure and temperature conditions that occur during the cleaning technique of the invention when a compound such as carbon dioxide is utilized as the dominant constituent of the cleaning fluid. Pressure P along the vertical axis in FIG. 2 is absolute pressure. Temperature T along the horizontal axis in FIG. 2 is relative temperature in Celsius (degrees centigrade). Conversion to absolute temperature in Kelvin is achieved by adding 273.15 to the relative temperature in Celsius. Certain of the temperature parameters in FIG. 2 are given in both relative and absolute temperature values.

Beginning near the lower left-hand corner of FIG. 2, the triple point is the point at which the solid, liquid, and gaseous phases of an element or compound exist in equilibrium. Let $P_{TP}$ and $T_{TP}$ respectively represent the absolute values of pressure and temperature at the triple point of the element or compound. For carbon dioxide, absolute triple-point pressure value $P_{TP}$ is 5.1 atm. Absolute triple-point temperature value $T_{TP}$ for carbon dioxide is 216K corresponding to −57° C.

An element or compound is in the regime above the triple point of the element or compound when the absolute pressure of the element or compound exceeds its triple-point pressure value $P_{TP}$. In the regime above the triple point (but below the plasma regime), the element or compound can be a liquid or a gas, and is therefore a fluid. The liquidus line separates the liquid and gas phases of the fluid.

The absolute temperature of a fluid is generally greater than its triple-point temperature value $T_{TP}$ in the regime above the triple point. However, the solidus line that separates the fluid's solid and liquid phases may bend to the left or right with increasing pressure. If the solidus line bends to the left with increasing pressure, the temperature of the fluid in its liquid phase drops below $T_{TP}$ in part of the region above the triple point.

In going from the triple point up the liquidus line, the critical point is eventually reached. At the critical point, the liquid and gaseous phases of the fluid are essentially indistinguishable in terms of chemical and physical properties. In particular, the surface tension between the liquid and gaseous states vanishes. Let $P_C$ and $T_C$ respectively represent the absolute values of pressure and temperature at the critical point of the fluid. For carbon dioxide, absolute critical pressure value $P_C$ is 72.9 atm. Absolute critical temperature $T_C$ for carbon dioxide is 304.5K corresponding to 31.3° C.

When the temperature of a fluid exceeds its critical temperature value $T_C$, the fluid exists in only one phase (excluding the plasma regime), often termed the supercritical fluid phase. In this (substantially non-ionized) phase, the fluid is generally termed a "supercritical fluid". A supercritical fluid is in the "supercritical state" when, in addition to the fluid's absolute temperature exceeding critical temperature value $T_C$, the fluid's absolute pressure exceeds critical pressure value $P_C$ For carbon dioxide, the supercritical state arises when the carbon dioxide temperature is greater than 31.3° C., and the carbon dioxide pressure is simultaneously greater than 72.9 atm. The density and viscosity of a fluid in its supercritical state lie between those of the gaseous and liquid phases of the fluid.

The pressure of the cleaning fluid employed in the present invention needs to be quite high during the cleaning operation. At the minimum, the absolute pressure of the cleaning fluid exceeds the absolute pressure value $P_{TPD}$ at the triple point of the dominant constituent during the period in which a display component is being cleaned with the fluid. When carbon dioxide is the dominant constituent, the fluid's absolute pressure is thus greater than 5.1 atm during the cleaning operation.

To serve as a good cleaning agent, a fluid needs to penetrate into (permeate) the device being cleaned in order to collect contaminants so that the contaminant material can be carried away in the fluid. The ability to penetrate into the device is characterized in terms of the fluid's surface tension and the fluid's diffusivity or diffusion rate into the device, and by the wetting of the device by the fluid, i.e., by the contact angle of the fluid on the device. The fluid's penetration ability increases as the diffusivity increases and/or the surface tension decreases. Diffusivity generally increases with increasing temperature. Surface tension generally decreases with increasing temperature. Consequently, increasing the temperature of the present cleaning fluid generally enhances its ability to penetrate the device.

The ability to collect contaminants primarily involves dissolving the contaminant material and is characterized by the solvency of the fluid and the solubility of the contaminants in the fluid. Solvency and solubility generally increase with increasing fluid pressure. Increasing the pressure of the cleaning fluid therefore generally improves it ability to collect contaminants.

The solvency and diffusivity of the present cleaning fluid are at baseline levels when the fluid's absolute temperature and pressure respectively equal the absolute temperature value $T_{TPD}$ and the absolute pressure value $P_{TPD}$ at the triple point of the dominant constituent. Although the baseline solvency of the fluid is normally quite high compared to the fluid's solvency at standard pressure, it is generally desirable that the solvency of the cleaning fluid be even higher. With the absolute pressure value $P_{CD}$ at the critical point of the dominant constituent being at least five times its triple-point pressure value $P_{TPD}$, a suitable high solvency is achieved when the pressure of the cleaning fluid is at least 20%, preferably at least 30%, of critical pressure value $P_{CD}$. Referring to FIG. 2, the 20% $P_C$ line for carbon dioxide occurs at 14.6 atm. This is approximately three times the triple-point pressure value $P_{TP}$ for carbon dioxide.

Similar to what occurs with solvency, it is normally desirable that the fluid's diffusivity be higher than the baseline diffusivity value that occurs when the fluid's absolute temperature and pressure are respectively at the triple-point values $T_{TPD}$ and $P_{TPD}$ of the dominant constituent. Inasmuch as diffusivity increases with increasing temperature, the fluid's temperature during the cleaning operation is normally raised above triple-point value $T_{TPD}$. An adequate increase in diffusivity for cleaning sturdy components of a flat-panel display is normally achieved when the fluid's temperature during the cleaning operation reaches a value at least halfway between the dominant constituent's triple-point value $T_{TPD}$ and the absolute temperature value $T_{CD}$ at the critical point of the dominant constituent. This value is indicated as the 50% $\Delta T$ line in FIG. 2. The 50% $\Delta T$ line for carbon dioxide is −12° C. or 261K. The pressure/temperature regime in which the fluid's temperature reaches a value at least halfway from $T_{TPD}$ to $T_{CD}$ and in which the fluid's pressure exceeds $P_{TPD}$, typically being at least 20–30% of $P_{CD}$, is thus particularly suitable for cleaning sturdy display components.

The pressure and temperature of the present cleaning fluid can vary during the cleaning operation. In so doing, part or all of the fluid may switch between the liquid and gaseous states. For example, when the dominant constituent forms largely all of the cleaning fluid, the fluid's pressure and temperature may cross the liquidus line for the dominant constituent. Switching between the liquid and gaseous states of the dominant constituent can also be achieved by going above the dominant constituent's liquidus line and through the supercritical state.

Transitions between the liquid and gaseous states of the cleaning fluid invariably take some time because energy must be supplied to, or removed from, the cleaning fluid. Depending on how the switching is implemented, both the liquid and gaseous phases of the fluid may be simultaneously present for some significant finite time during the switching period. In the situation where the dominant constituent forms largely all the cleaning fluid, the liquidus line of the dominant constituent may be crossed during the switching period, thereby resulting in the liquid and gaseous phases of the dominant constituent being simultaneously present. When both the liquid and gaseous phases of the cleaning fluid are simultaneously present, surface tension exists at the resultant liquid-gas interface or interfaces.

Surface tension can sometimes be damaging to a delicate display component. In cleaning a delicate display component, the cleaning operation is preferably conducted in such a way that the component is not simultaneously subjected to both liquid and gaseous portions of the cleaning fluid. This typically entails avoiding the simultaneous presence of the fluid's liquid and gaseous phases. Variations in the fluid's temperature and pressure can, for instance, be performed in such a way that the cleaning fluid is a gas during the entire cleaning period.

When the dominant constituent forms largely all of the cleaning fluid during the cleaning of a delicate display component, the fluid's temperature and pressure can be varied so that transitions between the liquid and gaseous states go through the supercritical state of the dominant constituent and therefore avoid crossing its liquidus line. The component is therefore not subjected to surface tension during the liquid-gas transitions. If the cleaning fluid includes at least one other significant constituent besides the dominant constituent, transitions between the liquid and gaseous states can be made above the liquidus lines of all the significant constituents. Absent certain types of interactions between the constituents, the simultaneous presence of the liquid and gas phases of the fluid is normally avoided, thereby avoiding subjecting the delicate display component to surface tension. At the start and finish of the cleaning of a delicate display component, the fluid's temperature and pressure are typically controlled so that the fluid is a gas in order to avoid subjecting the component to surface tension that would be present as the component is placed into, or removed from, liquid material of the fluid.

Light-emitting device 12 is typically a delicate display component for which simultaneous exposure of device 12 to liquid and gaseous portions of the cleaning fluid is preferably avoided. On the other hand, field emitter 10 is a relatively sturdy display component that can normally tolerate being subjected to the surface tension that arises when emitter 10 is exposed simultaneously to liquid and gaseous portions of the cleaning fluid. In cleaning a sturdy display component such as emitter 10, the temperature and pressure of the cleaning fluid can be varied in such a way that crossing the liquidus line or lines of the significant constituent or constituents occurs during the cleaning period.

The diffusivity of the cleaning fluid reaches a high level when the fluid's temperature is controlled so that the dominant constituent is, or is close to being, a supercritical fluid during the cleaning operation. That is, the absolute temperature of the fluid is close to, or above, the absolute critical temperature value $T_{CD}$ of the dominant constituent. Specifically, the absolute temperature of the cleaning fluid is normally no more than 4% below absolute critical temperature value $T_{CD}$ during the cleaning operation. That is, the fluid's absolute temperature is normally at least 96% of $T_{CD}$. The fluid's absolute temperature is preferably at least 98% of $T_{CD}$, typically at least 99% of $T_{CD}$. When carbon dioxide is the dominant constituent, the 96%, 98%, and 99% $T_{CD}$ points respectively occur approximately at 291K (18° C.), 297K (24° C.), and 300K (27° C.).

The absolute temperature of the cleaning fluid is normally maintained at or above critical temperature value $T_{CD}$ of the dominant constituent during the cleaning operation, especially in cleaning a delicate component of a flat-panel display. When the dominant constituent forms largely all the cleaning fluid, the fluid is then substantially a supercritical fluid. Even though the fluid's pressure may vary during the cleaning procedure, no crossing of the liquidus line occurs during the cleaning operation. By maintaining the fluid's absolute temperature at or above $T_{CD}$ during the cleaning operation when the dominant constituent forms largely all the cleaning fluid, damage causable by liquid surface tension is automatically avoided.

When the dominant constituent does not form largely all of the cleaning fluid, there may, or may not, be an absolute temperature value above which the cleaning fluid can be characterized as being a supercritical fluid. Nonetheless, there is normally an absolute temperature value above which none of the fluid is in the liquid state. Depending on the mole fraction of each constituent, this temperature value is typically in the vicinity of critical temperature value $T_{CD}$ for the dominant constituent.

Similar to what happens with diffusivity, the solvency of the cleaning fluid reaches a high level when the absolute pressure of the fluid approaches, or goes above, critical pressure $P_{CD}$ of the dominant constituent. Specifically, the fluid's absolute pressure is normally at least 50% of $P_{CD}$ during the present cleaning operation. The fluid's absolute pressure is preferably at least 90% of $P_{CD}$ during the cleaning procedure. When carbon dioxide is the dominant constituent, the 50% and 90% $P_{CD}$ levels respectively occur approximately at 36 and 66 atm. The fluid's absolute pressure during the cleaning operation is typically at or above $P_{CD}$.

In implementations of the invention where the absolute temperature and pressure of the cleaning fluid respectively exceed critical values $T_{CD}$ and $P_{CD}$ of the dominant constituent, the fluid is largely in the supercritical state when the dominant constituent forms largely all the fluid. Consequently, the fluid's solvency and diffusivity are very high. Even when the dominant constituent does not form largely all the cleaning fluid, its solvency and diffusivity are still normally very high when the fluid's absolute temperature and pressure respectively exceed $T_{CD}$ and $P_{CD}$.

The ability of the present cleaning fluid to dissolve particles of contaminant, such as organic residues of the polyimide in the components of a flat-panel CRT display such as that of FIG. 1, in a commercially acceptable period of time depends on the species of contaminant being dissolved. The values of fluid pressure and temperature needed to achieve an adequately high solvency and dissolution rate for one species of contaminant may differ materially from the fluid pressure and temperature values needed to attain sufficiently high solvency and dissolution rate for another contaminant species. Depending on factors such as the amount of contaminant expected to be present in a display component, different regions of fluid pressure and temperature may be appropriate for removing different contaminant species.

With the foregoing in mind, the pressure and temperature of the cleaning fluid can be controlled in various ways during the cleaning operation of the invention. For example, the fluid's absolute pressure can be maintained at a largely constant value, either above or below $P_{CD}$. Likewise, the fluid's absolute temperature can be maintained at a largely constant value on either side of $T_{CD}$. The fluid's pressure and temperature can also be programmably adjusted depending, among other things, on the species of contaminant(s) being removed from the display component. For example, the fluid's temperature can be cycled between values above and below $T_{CD}$.

The cleaning operation of the invention is performed generally in the following manner to clean a display component such as field emitter 10 or light-emitting device 12 including any component attached to device 10 or 12 prior to initiation of the cleaning operation. The cleaning fluid is normally adjusted to be in the vicinity of suitable initial pressure and temperature values. The display component is then immersed in the fluid, normally for at least a prescribed time period. Molecules of contaminant, such as polyimide residue, dissolve in the fluid to form a solvate (a solute/solvent combination). The solvated contaminant is carried away in the cleaning fluid. Rather than dissolving in the cleaning fluid, certain contaminant species may become suspended in the fluid. Particles of such suspended contaminant are likewise carried away in the fluid. As appropriate, the fluid's pressure and temperature are adjusted during the cleaning period. At the end of the cleaning period, the display component is removed from the cleaning fluid and dried.

The present cleaning fluid may include one or more co-solvent additives for improving fluid permeation and solvency during the cleaning procedure. When the dominant constituent is carbon dioxide, suitable candidates for co-solvent additive include alkanols (alkyl alcohols) varying from methanol through hexanol, alkanoic acids varying from methanoic (formic) acid through hexanoic (caproic) acid, ketones such as dimethyl ketone (acetone) or methyl-ethyl ketone typically having up to eight carbon atoms, ethers such as methyl ether or ethyl ether having up to eight carbon atoms, alkyl cyanides varying from methyl cyanide (acetonitrile) through oxtyl cyanide, nitroparaffins varying from nitromethane through nitrobutane, corresponding alkyl derivatives, benzoic acid, phenol, alkylphenyl ketones with alkyl groups having up to six carbons atoms, alkylphenyl ethers with alkyl groups having up to six carbon atoms, and benzonitrile. The total amount of co-solvent additive is normally no more than 5% of the cleaning fluid by mole fraction.

The room-temperature standard-pressure gases in Table I other than carbon dioxide can variously be combined with carbon dioxide and when present, with co-solvent additive, to form the cleaning fluid. The same applies to the compounds in Table II. In addition, various combinations of the compounds listed in Tables I and II can be employed in the cleaning fluid in situations where one of these compounds other than carbon dioxide is the dominant constituent.

For removing organic residue from field emitter 10 when electron focusing structure 24 contains exposed positive-tone photopolymerizable polyimide, the formulation of the dense fluid used in the present dense-fluid cleaning technique is typically pure (neat) carbon dioxide. Emitter 10 is cleaned with this fluid formulation at an absolute fluid pressure of 15–40 atm, typically 20 atm, and a fluid temperature of 25–100° C., typically 50° C. The pressure and temperature of the cleaning fluid are typically held largely constant during the cleaning of emitter 10.

A small portion of the cleaning fluid, along with some of the dissolved or/and suspended contaminant, typically remains in field emitter 10 after the fluid cleaning operation is complete. This portion of the cleaning fluid may be physically bonded to the otherwise cleaned emitter 10 or/and reversibly chemically bonded to emitter 10. In any event, this remaining portion of the cleaning fluid and accompanying contaminant, if not removed, could later cause loss in display performance. Accordingly, a post-cleaning operation is performed to largely remove the remainder of the cleaning fluid and accompanying contaminant from emitter 10.

The post-cleaning operation is typically a high-temperature operation in which field emitter 10 is heated in a chamber at a high vacuum. The chamber temperature is typically raised from room temperature (in the vicinity of 25° C.) to 300–500° C., typically 420–440° C., maintained at that temperature for 2–24hrs, typically 6 hrs, and then returned to a value close to room temperature. The total heating/cooling time is 8–32 hrs, typically 12–14 hrs. The chamber pressure is maintained below 1 torr, typically $10^{-7}$ torr, during the heating operation by pumping the vacuum chamber with a suitable vacuum pump. Instead of using a high vacuum, the heating operation can be done in the presence of a suitable non-damaging gas such as helium, argon, neon, hydrogen, nitrogen, or any of the compounds in Tables I and II, to the extent that they are in the gas phase at the pressure and temperature employed in the heating operation.

Alternatively or additionally, the post-cleaning operation can entail subjecting field emitter 10 to actinic radiation, typically ultraviolet ("UV") or/and visible light. A mercury discharge lamp typically provides such UV light, principally at wavelengths of 254 and 360 nm. When particles of the cleaning fluid are reversibly chemically bonded to the otherwise cleaned material, the actinic radiation acts to break the chemical bonds. The actinic radiation can also break physical bonds between the cleaned material and particles of the cleaning fluid. The exposure of emitter 10 to actinic radiation is typically done in a vacuum chamber while the chamber pressure is maintained below 1 torr, typically $10^{-7}$ torr. A gas, such as any of those specified above for the post-cleaning operation, can be flowed over emitter 10, typically at room pressure (approximately 1 atm), to help remove the excess cleaning fluid at the end of the radiation-exposure step.

When black matrix 34 in light-emitting device 12 consists of exposed positive-tone photopolymerizable polyimide, organic residue is removed from device 12 using the same formulation of the cleaning fluid, and at the same temperature and pressure conditions, used for cleaning field emitter 10. If getter 18 is mounted on device 12 prior to the cleaning step, the organic adhesive, typically polyimide, that bonds the getter-attachment clips to device 12 is cleaned at the same time with this formulation of the cleaning fluid. A post-cleaning operation is likewise performed to largely remove any cleaning fluid, including dissolved or/and suspended contaminant, that remains in device 12 after the cleaning step. As generally described above for emitter 10, the post-cleaning operation for device 12 can be performed by heating device 12 in a high vacuum or other non-reactive environment or/and exposing device 12 to actinic radiation consisting of UV or/and visible light.

Figure 3A:
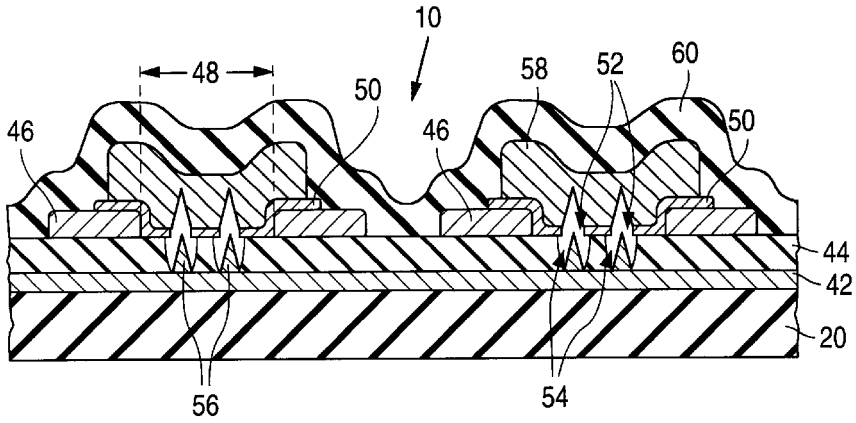
FIGS. 3*a*–3*c* are cross-sectional side structural views representing steps in a process for manufacturing, including cleaning, an electron-emitting device of a flat-panel CRT display according to the invention.
Figure 3B:
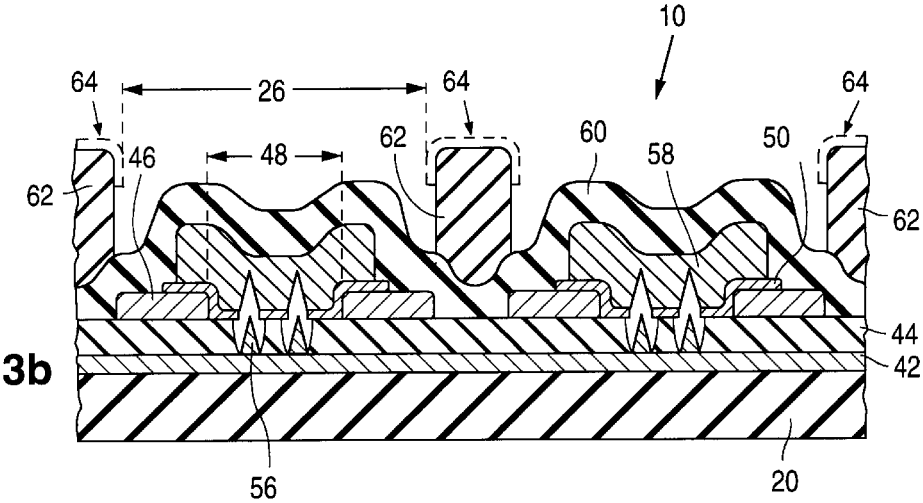
Figure 3C:
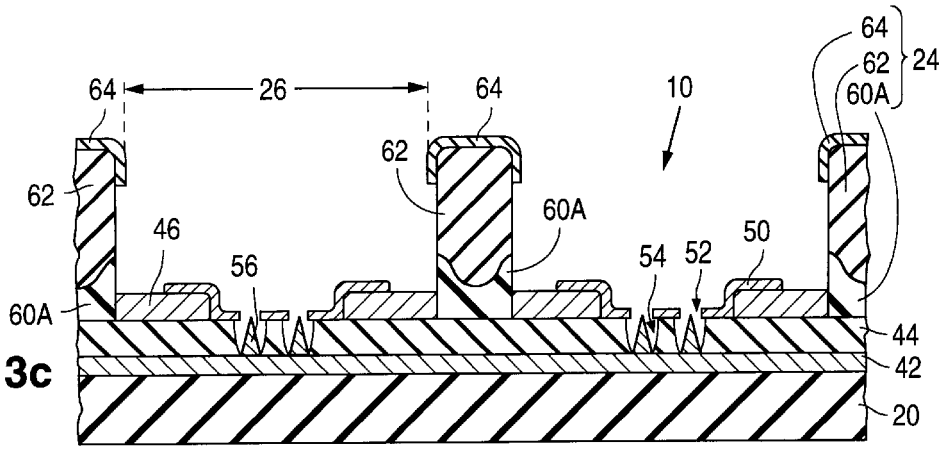

FIGS. 3*a*–3*c* (collectively "FIG. 3") illustrate how field emitter 10 is manufactured according to an exemplary process that entails cleaning emitter 10 according to the invention. The starting point for the process of FIG. 3 is baseplate 20. See FIG. 3*a*. A lower region 42 that contains emitter electrodes (not separately shown) overlies baseplate 20. A dielectric layer 44 lies on lower region 42. Control electrodes 46 are situated on dielectric layer 44. Control apertures 48 extend through control electrodes 46. A gate portion 50 spans each control aperture 48. Multiple gate openings 52 extend through each gate portion 50 within its control aperture 48. A dielectric opening 54 extends through dielectric layer 44 below each gate opening 52. Conical electron-emissive elements 56 consisting of suitable emitter cone material are respectively provided in composite openings 52/54. Excess regions 58 of the emitter cone material overlie gate portions 50. A protective layer 60 optionally lies on top of the structure.

A base focusing structure 62 for electron-focusing system 24 is formed on protective layer 60. See FIG. 3*b*. Base focusing structure 62 is created from positive-tone photopolymerizable polyimide that has been selectively exposed to actinic radiation and developed to remove the unexposed polyimide. Protective layer 60 (when present) prevents the materials utilized in forming structure 62 from contaminating or otherwise damaging electron-emissive cones 56.

At any of several points subsequent to the formation of base focusing structure 62, field emitter 10 is cleaned according to the cleaning technique of the invention using the fluid formulation prescribed above at the specified temperature and pressure conditions to remove contaminants, including organic residues. The overall cleaning procedure includes the above-described post-cleaning operation for removing the remainder of the cleaning fluid and accompanying contaminant. The post-cleaning operation can be performed directly after the fluid-cleaning operation or subsequent to additional processing steps performed on emitter 10. The fluid-cleaning operation is preferably done on emitter 10 directly after forming base focusing structure 62. In this case, the post-cleaning operation can be performed directly after the fluid-cleaning operation or at a later point, typically just before the assembly of emitter 10 and light-emitting device 12.

A thin electrically conductive focus coating 64 is formed on base focusing structure 62. Focus coating 64 is typically created after excess emitter-material regions 58 and the exposed portions of protective layer 60 (when present) are removed. However, focus coating 64 can be created earlier, as indicated by the dashed lines used to indicate coating 64 in FIG. 3*b*. At least the fluid-cleaning portion of the overall cleaning operation can be performed on focusing structure 62 when coating 64 is present with excess regions 58 and protective layer 60 overlying electron-emissive cones 56.

The exposed portions of protective layer 60 (when present) are removed with a suitable etchant. FIG. 3*c* shows the resultant structure in which item 60A is the remainder of protective layer 60. Excess emitter-material portions 58 are subsequently removed. If not already present, focus coating 64 is formed on focusing structure 62. Remaining protective layer 60A, focusing structure 62, and focus coating 64 now constitute focusing system 24. Components 42, 44, 46, 50, and 56 form electron-emitting mechanism 22.

If not done earlier, the present fluid-cleaning operation is performed on field emitter 10. Also, the fluid-cleaning operation can, if desired, be performed on emitter 10 at this point and at either of the earlier points mentioned above. That is, the fluid-cleaning operation can be performed two or more times during the fabrication of emitter 10. In any event, the post-cleaning operation is subsequently done to complete the cleaning procedure.

Figure 4A:
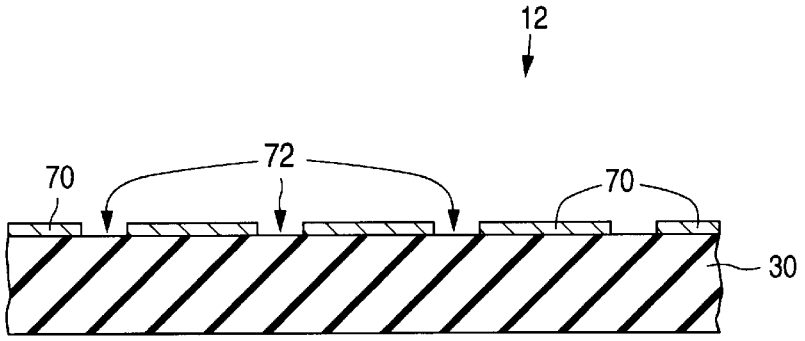
FIGS. 4*a*–4*d* are cross-sectional side structural views representing steps in a process for manufacturing, including cleaning, a light-emitting device of a flat-panel CRT display according to the invention.
Figure 4B:
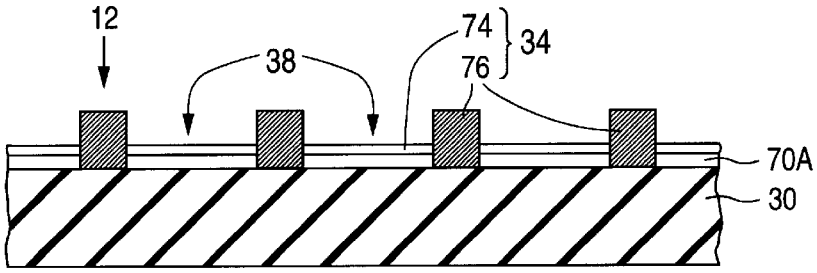

FIGS. 4*a*–4*d* (collectively "FIG. 4") depict how light-emitting device 12 is manufactured according to an exemplary process that involves cleaning device 12 according to the invention. Device 12 in FIG. 4 is illustrated upside down relative to device 12 in FIG. 1. To begin the process of FIG. 4, faceplate 70 is provided with an array of rectangular sacrificial masking portions 70 as shown in FIG. 4*a*. Item 72 indicates a waffle-like opening that separates masking portions 70 from one another.

Black matrix 34 is created by forming short row strips 74 and tall column strips 76 in portions of opening 72. See FIG. 4*b*. Black-matrix strips 74 and 76 are formed from positive-tone photopolymerizable polyimide that has been selectively exposed to actinic radiation, developed to remove the unexposed polyimide, and pyrolyzed to blacken the remaining polyimide. The exposed material of masking portions 70 is removed to produce the structure shown in FIG. 4*b*. Items 70A are the remainder of masking portions 70. Openings 38 extend through composite black matrix 34 formed with strips 74 and 76.

Figure 4C:
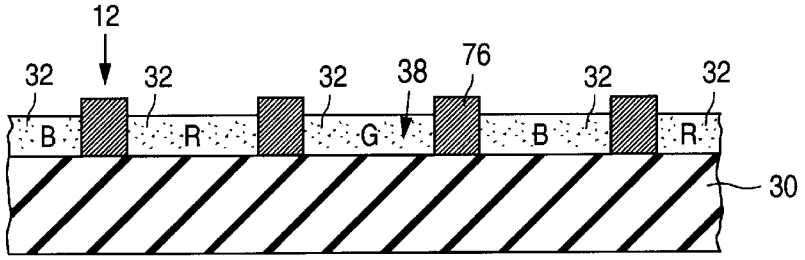
Figure 4D:
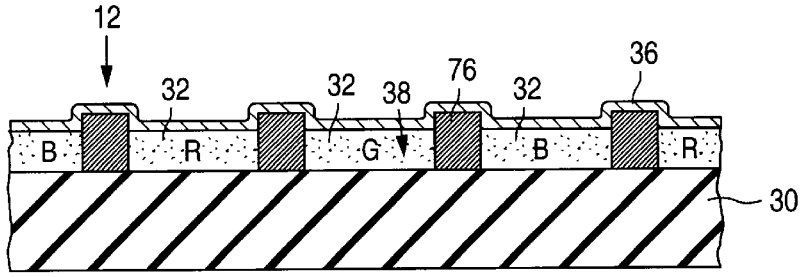

Light-emitting device 12 is subsequently cleaned according to the invention using the fluid formulation described above at the specified temperature and pressure conditions. Organic residues of the polyimide are thereby removed. The post-cleaning operation is performed directly after the fluid-cleaning operation or at a later point to remove the remainder of the cleaning fluid and accompanying contaminant. Light-emissive phosphor regions 32 are deposited in openings 38 as shown in FIG. 4*c*. Anode layer 36 is subsequently deposited on top of the structure to produce cleaned device 12 as depicted in FIG. 4*d*.

Getter 18 is typically mounted on light-emitting device 12 during the display assembly process, just before sealing devices 10 and 12 together through the outer wall. If desired, the cleaning operation can be repeated on device 12 just before sealing in order to clean the getter-attachment clips that are typically bonded to device 12 with polyimide adhesive.

Figure 5:
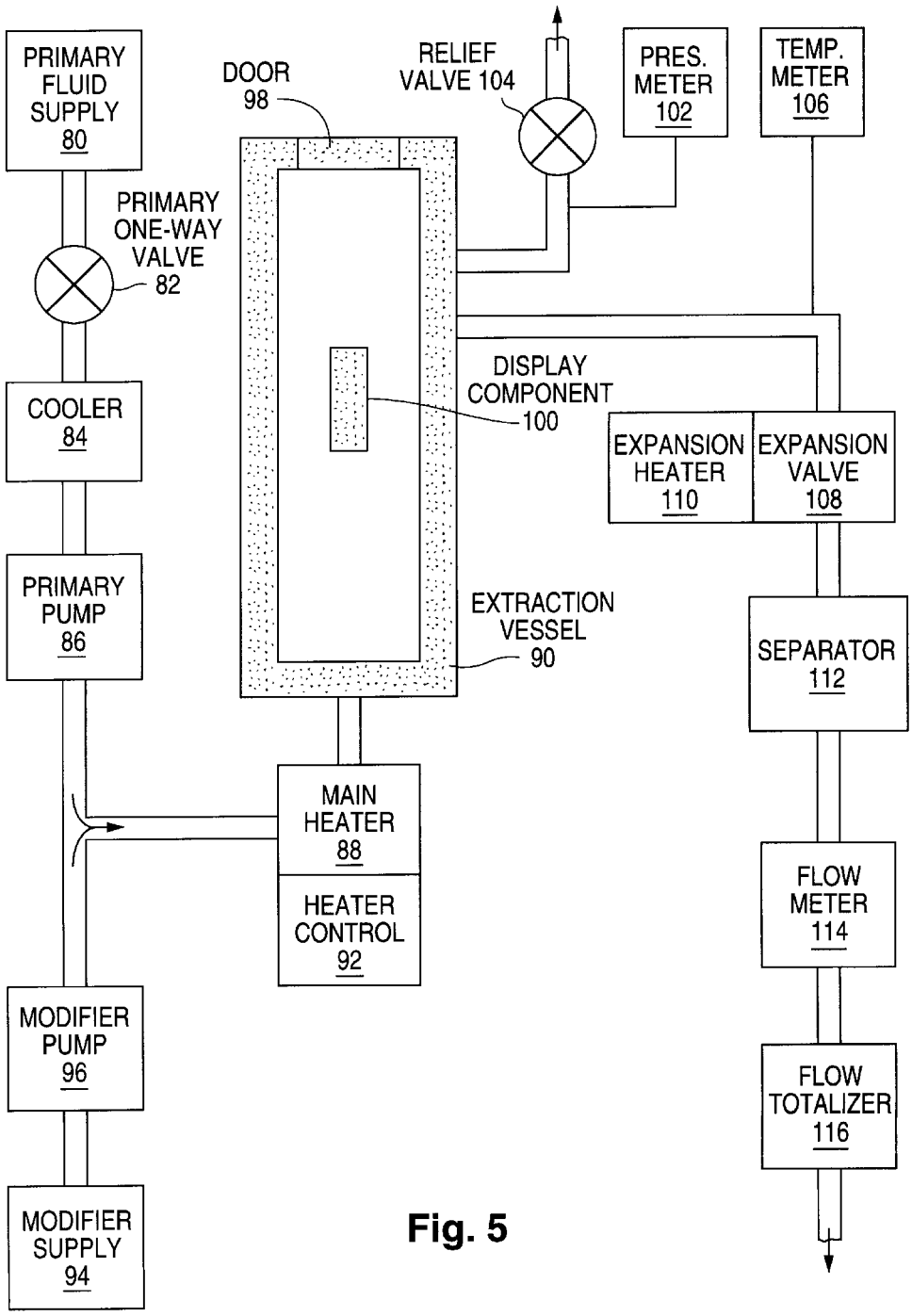
FIG. 5 is a block diagram of a system for cleaning a device, such as a polyimide-containing component of a flat-panel CRT display, according to the invention.

FIG. 5 schematically illustrates a system utilized in performing the fluid-cleaning technique of the invention on components of a flat-panel CRT display. The dominant constituent of the cleaning fluid is provided from a primary fluid supply 80 through a primary one-way valve 82, a cooler 84, a primary pump 86, and a main heater 88 to the fluid inlet of an extraction vessel 90. A heater control 92 controls the temperature to which main heater 88 heats the fluid entering extraction vessel 90.

In combining the dominant constituent with a modifier such as a co-solvent additive to form the cleaning fluid, the modifier is provided from a modifier supply 94 through a modifier pump 96, including a modifier one-way valve (not shown), to the line leading to main heater 88. If no modifier is to be employed, modifier supply 94 and modifier pump 96 can be deleted from the cleaning system. The dominant constituent provided from primary fluid supply 80 then forms the cleaning fluid.

Extraction vessel 90 has a door 98 through which a component 100 of the flat-panel CRT display is inserted into vessel 90 prior to the fluid-cleaning operation and removed from vessel 90 after the fluid-cleaning operation. Vessel 90 normally has a mechanism (not shown) that can hold a group of display components 100. Each display component 100 is field emitter 10, light-emitting device 12, or any other display component to be cleaned.

A pressure meter 102 provides a readout of the controlled pressure of the cleaning fluid in extraction vessel 90. Pressure meter 102 is connected to a line having a relief valve 104 by which the pressure in extraction vessel 100 is prevented from exceeding safe limits. A temperature meter 106 connected to the fluid outlet of extraction vessel 90 furnishes a readout of the temperature of the cleaning fluid.

The cleaning fluid that exits vessel 90 carries the removed contaminant, normally largely in solvate form. The exiting fluid passes through an expansion valve 108 having an expansion heater 110, and is supplied to a separator 112. Expansion valve 108 adjusts the pressure of the exiting fluid to a value close to room pressure. Separator 112 removes contaminants from the exiting fluid.

The resultant cleaning fluid, now substantially contaminant free, passes through an optional flow meter 114 and an optional flow totalizer 116. Flow meter 114 determines the instantaneous flow rate of the exiting de-contaminated fluid.

Flow totalizer 116 determines the total amount of fluid used. After passing through totalizer 116, the exiting substantially room-pressure de-contaminated cleaning fluid is either vented to the atmosphere or reclaimed for future use.

Directional terms such as "lower" and "top" have been employed in describing a flat-panel CRT display cleaned according to the invention in order to establish a frame of reference by which the reader can more easily understand how the various parts of the display fit together. In actual practice, the components of a flat-panel CRT display may be situated at orientations different from that implied by the directional terms used here. Inasmuch as directional terms are used for convenience to facilitate the description, the invention encompasses implementations in which the orientations differ from those strictly covered by the directional terms employed here.

While the invention has been described with reference to particular embodiments, this description is solely for the purpose of illustration and is not to be construed as limiting the scope of the invention claimed below. For example, after field emitter 10 and light-emitting device 12 of a flat-panel CRT display are joined together through the outer wall, but before the internal display pressure is pumped down to the desired low operational level, the present cleaning procedure can be performed on the assembled display to clean all of its components simultaneously. Co-solvent additives besides those described above can be employed in the cleaning fluid. Post cleaning to remove any remainder of cleaning fluid can be conducted by techniques other than the high-temperature and actinic radiation techniques described above.

Contaminants other than unreacted constituents of exposed photopolymerizable polyimide can be removed from components of a flat-panel display by using the present supercritical cleaning technique. Examples of other contaminants include polymeric residues other than polyimide, certain oxide residues, various greasy residues, polyimide catalysts, and surfactants, many of which arise from pre-polyimide processing steps.

Field emitter 10 and light-emitting device 12 can be fabricated according to processes other than those of FIGS. 3 and 4. The present cleaning technique can also be utilized to clean flat-panel liquid-crystal displays, flat-panel plasma displays, and other flat-panel displays besides flat-panel CRT displays. Various modifications and applications may thus be made by those skilled in the art without departing from the true scope and spirit of the invention as defined in the appended claims.

We claim:

1. A method of cleaning a component of a flat-panel display with a fluid, the fluid having a mole-fraction dominant constituent which has a triple point and a critical point, the fluid having an absolute pressure and an absolute temperature, the method comprising the step of subjecting the component of the flat-panel display to the fluid while the fluid's absolute pressure exceeds the absolute pressure value at the triple point of the dominant constituent and is at least 20% of the absolute pressure value at the critical point of the dominant constituent.

2. The method of claim 1 wherein the dominant constituent is greater than the mole-fraction of the remainder of the fluid.

3. The method of claim 1 wherein, during the subjecting step, the fluid's absolute temperature reaches at least half-way from the absolute temperature value at the triple point of the dominant constituent to the absolute temperature value at the critical point of the dominant constituent.

4. The method of claim 1 wherein, during the subjecting step, the fluid's absolute temperature reaches at least 96% of the absolute temperature value at the critical point of the dominant constituent.

5. The method of claim 1 wherein, during the subjecting step, the fluid's absolute temperature goes above the absolute temperature value at the critical point of the dominant constituent.

6. The method of claim 1 wherein, during the subjecting step, the fluid's absolute pressure reaches at least 50% of the absolute pressure value at the critical point of the dominant constituent.

7. The method of claim 1 wherein, during the subjecting step, the fluid's absolute pressure reaches at least 90% of the absolute pressure value at the critical point of the dominant constituent.

8. The method of claim 1 wherein, during the subjecting step, the fluid's absolute pressure goes above the absolute pressure value at the critical point of the dominant constituent.

9. The method of claim 1 wherein the component is not simultaneously subjected to liquid and gaseous portions of the fluid during the subjecting step.

10. The method of claim 1 wherein the flat-panel display is a flat-panel cathode-ray tube display.

11. The method of claim 1 wherein organic material of the component enters the fluid during the subjecting step.

12. The method of claim 1 wherein the subjecting step entails placing the component in a vessel with the fluid being introduced into the vessel so that the fluid contacts the component.

13. The method of claim 1 further including, subsequent to the subjecting step, the step of separating the fluid and the component.

14. The method of claim 1 wherein the dominant constituent is in gaseous phase at an absolute pressure value of 1 atm and a temperature value of 25° C.

15. The method of claim 1 wherein the fluid includes at least one additive for enhancing solvency.

16. The method of claim 1 wherein (a) the dominant constituent has a liquidus line and a supercritical state, (b) the fluid has a liquid state and a gaseous state, and (c) the fluid transitions between the fluid's liquid and gaseous states during the subjecting step by going through the dominant constituent's supercritical state, thereby substantially avoiding crossing the dominant constituent's liquidus line during the subjecting step.

17. The method of claim 8 wherein, during the subjecting step, the fluid's absolute temperature reaches at least 96% of the absolute temperature value at the critical point of the dominant constituent.

18. The method of claim 8 wherein, during the subjecting step, the fluid's absolute temperature goes above the absolute temperature value at the critical point of the dominant constituent.

19. The method of claim 9 wherein the fluid is not simultaneously present in its liquid and gaseous states during the subjecting step.

20. The method of claim 10 wherein the component comprises an electron-emitting device or a light-emitting device.

21. The method of claim 11 wherein the organic material comprises polyimide.

22. The method of claim 13 wherein the separating step includes heating the component in a vacuum or in another environment substantially non-damaging to the component.

23. The method of claim 13 wherein the separating step includes subjecting the component to actinic radiation.

24. The method of claim 14 wherein the dominant constituent is carbon dioxide.

25. The method of claim 13 wherein the separating step include reclaiming the fluid for future use.

26. The method of claim 13 wherein (a) material of the component enters the fluid during the subjecting step and (b) the separating step includes separating the fluid and the material of the component.

27. The method of claim 23 wherein the actinic radiation comprises at least one of ultraviolet light and visible light.

28. The method of claim 21 wherein the polyimide material comprises exposed photopolymerizable polyimide.

* * * * *